US009162448B2

(12) United States Patent
Yuda

(10) Patent No.: US 9,162,448 B2
(45) Date of Patent: Oct. 20, 2015

(54) DOT RECORDING APPARATUS, DOT RECORDING METHOD, AND COMPUTER PROGRAM THEREFOR

(71) Applicant: SEIKO EPSON CORPORATION, Tokyo (JP)

(72) Inventor: Tomohiro Yuda, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/326,990

(22) Filed: Jul. 9, 2014

(65) Prior Publication Data

US 2015/0015624 A1 Jan. 15, 2015

(30) Foreign Application Priority Data

Jul. 12, 2013 (JP) ..... 2013-147018

(51) Int. Cl.

| | |
|---|---|
| ***B41J 29/38*** | (2006.01) |
| ***B41J 2/205*** | (2006.01) |
| ***B41J 2/045*** | (2006.01) |
| ***B41J 2/21*** | (2006.01) |

(52) U.S. Cl.

CPC ..... *B41J 2/04595* (2013.01); *B41J 2/2056* (2013.01); *B41J 2/2132* (2013.01)

(58) Field of Classification Search

CPC ..... B41J 2/2132

See application file for complete search history.

(56) References Cited

U.S. PATENT DOCUMENTS

| | | | | |
|---|---|---|---|---|
| 5,633,663 | A | 5/1997 | Matsubara et al. | |
| 8,233,188 | B2 * | 7/2012 | Nashimoto | 358/1.8 |
| 2007/0236745 | A1 | 10/2007 | Noguchi et al. | |
| 2008/0079960 | A1 * | 4/2008 | Yamazaki | 358/1.8 |
| 2009/0091785 | A1 | 4/2009 | Yokouchi et al. | |
| 2011/0227982 | A1 * | 9/2011 | Marumoto et al. | 347/14 |
| 2012/0268752 | A1 * | 10/2012 | Komamiya et al. | 358/1.2 |

FOREIGN PATENT DOCUMENTS

| | | | |
|---|---|---|---|
| JP | 06-022106 | | 1/1994 |
| JP | 2006231736 | A * | 9/2006 |
| JP | 2007-268825 | | 10/2007 |
| JP | 2007-306550 | | 11/2007 |

* cited by examiner

*Primary Examiner* — Shelby Fidler
(74) *Attorney, Agent, or Firm* — Workman Nydegger

(57) ABSTRACT

A main scan pass which relatively moves a recording head and a recording medium in a main scan direction and forms dots on the recording medium, and a sub-scan which relatively moves the recording medium and the recording head in a sub-scan direction that intersects with the main scan direction, are performed, and thereby multi-pass recording which completes forming of the dots on a main scan line by N (2 or more) main scan passes is performed. A dot rate represents a rate of pixels in which dot recording is performed in each main scan pass and is set so as to be changed gradually and periodically over sections in the main scan direction. The number of values of the dot rates different from each other in the plurality of sections lined up in the main scan direction is set so as to be equal to or greater than 3.

7 Claims, 14 Drawing Sheets

1P: Z1 (MS1*o)

+

2P: Y2 (MS1o)

+

3P: X3 (MS1*e)

+

4P: W4 (MS1e)

⇩

AREA Q4

ODD NUMBER ROW DOT

EVEN NUMBER ROW DOT

DOT RECORDING APPARATUS, DOT RECORDING METHOD, AND COMPUTER PROGRAM THEREFOR

The present application claims priority to Japanese Patent Application No. 2013-147018 filed on Jul. 12, 2013 which is hereby incorporated by reference in its entirety.

BACKGROUND

1. Technical Field

Embodiments of the present invention relate to a dot recording apparatus, a dot recording method, and a computer program therefor.

2. Related Art

In a known printing apparatus that functions as a dot recording apparatus, a plurality of recording heads that eject inks of different colors with respect to recording materials are moved forwards and backwards. A main scan is performed at the time of a forward movement and a backward movement. In this manner, printing is performed. (for example, JP-A-6-22106). In this printing apparatus, within an area where printing can be performed by one time of a main scan, pixel groups configured by m×n pixels are arranged such that the pixel groups are not adjacent to each other. In addition, a plurality of main scans is performed using a plurality of thinning patterns which are in a mutually complementary arrangement relationship and thereby the recording is completed.

However, in the above-described printing apparatus, each pixel group has a rectangular shape. A boundary between the pixel groups may include a side that is parallel with a main scan direction and a side that is parallel with a sub-scan direction. A long boundary extending in the main scan direction and a long boundary extending in the sub-scan direction are formed by a set of the boundaries of the pixel groups that are adjacent to each other. For this reason, banding (image quality deterioration area) along such long boundaries may easily occur and may stand out.

In addition, there is a problem in the printing apparatus in that the banding of the main scan direction easily stands out. In particular, in the above-described printing apparatus, there is a problem that the banding of the main scan direction occurring at such a boundary is easily stands out since a pixel group which is a target of ink ejection and a pixel group which is not the target of ink ejection are arranged in a form of being tiled with each other. These problems are not limited to the printing apparatus, and commonly occur in a dot recording apparatus that records dots on a recording medium (dot recording medium).

SUMMARY

Embodiments of the invention can be realized in the following forms or application examples.

According to embodiments of the invention, a dot recording apparatus is provided and may include a recording head which has a plurality of nozzles, a main scan driving mechanism which relatively moves the recording head and a recording medium in a main scan direction and which performs a main scan pass that forms dots on the recording medium, a sub-scan driving mechanism which performs a sub-scan that relatively moves the recording medium and the recording head in a sub-scan direction that intersects with the main scan direction. The dot recording apparatus may also include a control unit. The control unit performs multi-pass recording which completes forming of the dots on a main scan line by performing N (N is an integer equal to or greater than 2) main scan passes. A dot rate represents a rate of pixels in which dot recording is performed in each main scan pass of the multi-pass recording. The dot rate is set so as to be changed gradually and periodically over a plurality of sections in the main scan direction. The number of values of the dot rates different from each other in the plurality of sections lined up in the main scan direction is set so as to be equal to or greater than 3.

According to the aspect of the dot recording apparatus, since a dot rate of each section in the main scan direction of each main scan pass is set so as to be changed gradually and periodically, dot recording in the main scan direction can be divided for each section. As a result, banding along the main scan direction can be suppressed from occurring. In addition, by changing the dot rate gradually and periodically for each section, a rapid change of the dot rate for each section along the main scan direction can be suppressed, and thus it is possible to configure the banding along the main scan direction so that the banding does not stand out.

(2) In the dot recording apparatus, each section may be separated by a boundary with a non-linear shape repeated in a predetermined period along the sub-scan direction. In the dot recording apparatus, since the dot rate of not only the main scan direction but also the sub-scan direction can be changed gradually and periodically, the banding along the sub-scan direction can be suppressed from occurring. In addition, since a rapid change of the dot rate for each section along the sub-scan direction can be suppressed, it is possible to configure the banding occurring along the sub-scan direction so that the banding does not stand out.

(3) In the dot recording apparatus, the non-linear shape is set in such a manner that a shape of a first half period and a shape of a second half period of the period have mirror symmetry. In this case, it is easy to set a complementary relationship between a first pass and a second pass.

(4) In the dot recording apparatus, the non-linear shape may be a zigzag shape with a tilt of 45 degrees with respect to the main scan direction and the sub-scan direction. In this case, it is easy to set the complementary relationship between the first pass and the second pass, and it is possible to realize the most efficient suppression of the banding in the main scan direction and suppression of the banding in the sub-scan direction.

In addition, embodiments of the invention can be realized by various forms such as a recording method, a computer program, and a recording medium in which the computer program is stored, in addition to the dot recording apparatus.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Figure 1:
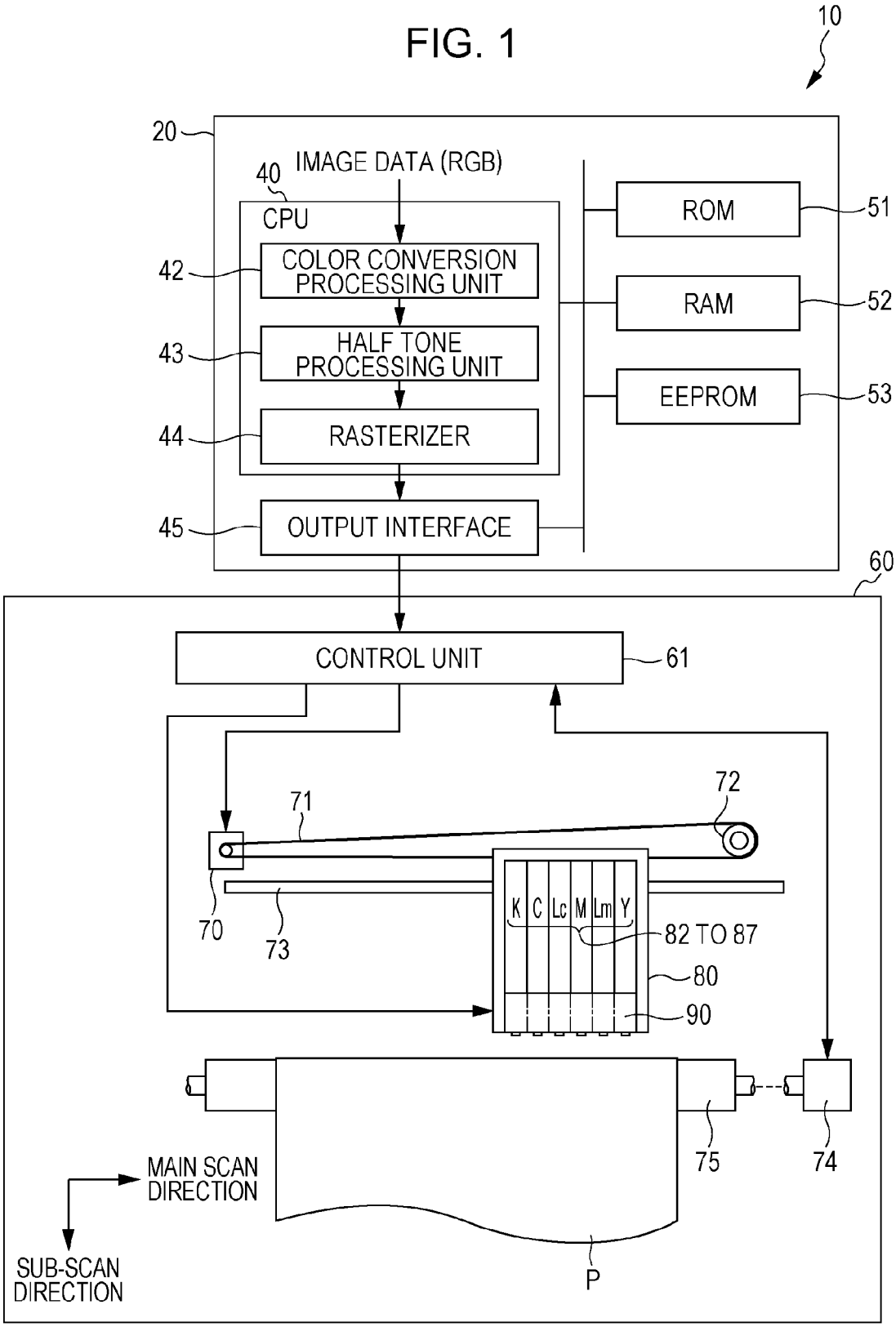
FIG. 1 is an explanatory diagram illustrating an example of a configuration of a dot recording system.

Embodiments of the invention relate to systems and methods for recording dots. FIG. 1 is an explanatory diagram illustrating an example of a configuration of a dot recording system. The dot recording system 10 includes an image processing unit 20 and a dot recording unit 60. The image processing unit 20 generates print data for the dot recording unit 60 from image data (for example, image RGB data).

The image processing unit may include a CPU 40 (referred to as "control unit 40"), a ROM 51, a RAM 52, an EEPROM 53, and an output interface 45. The CPU 40 has functions of a color conversion processing portion 42, a halftone processing portion 43, and a rasterizer 44. Such functions are realized by a computer program. The color conversion processing portion 42 converts multiple gradation RGB data of an image into ink amount data which represents an amount of ink of a plurality of colors. The halftone processing portion 43 generates dot data illustrating a dot forming state for each pixel, by performing halftone processing with respect to the ink amount data. The rasterizer 44 rearranges the dot data generated by the halftone processing into the dot data which is used in each main scan performed by the dot recording unit 60. An operation of dot recording which is explained in the following various embodiments is a rasterizing operation (that is, an operation which is represented by raster data) which is realized by the rasterizer 44.

The dot recording unit 60 may be, for example, a serial type ink jet recording apparatus, and may include a control unit 61, a carriage motor 70, a driving belt 71, a pulley 72, a sliding shaft 73, a paper feeding motor 74, a paper feeding roller 75, a carriage 80, ink cartridges 82 to 87, and a recording head 90.

The driving belt 71 is stretched between the carriage motor 70 and the pulley 72. The driving belt 71 is attached to the carriage 80. In the carriage 80, the ink cartridges 82 to 87 which respectively contain, for example, cyan ink (C), magenta ink (M), yellow ink (Y), black ink (K), light cyan ink (Lc), and light magenta ink (Lm) are built. In addition, various inks other than these inks can be used as the ink. In the recording head 90 located in the lower portion of the carriage 80, nozzle rows corresponding to the above-described various color inks are formed. When the ink cartridges 82 to 87 are mounted on the carriage 80 from above, the ink can be supplied from each cartridge to the recording head 90. The sliding shaft 73 is arranged in parallel with the driving belt, and penetrates the carriage 80.

If the carriage motor 70 drives the driving belt 71, the carriage 80 moves along the sliding shaft 73. This direction is referred to as a "main scan direction" or a "main scanning direction". A main scan driving mechanism may include the carriage motor 70, the driving belt 71, and the sliding shaft 73. According to the movement of the carriage 80 in the main scan direction, the ink cartridges 82 to 87 and the recording head 90 also move in the main scan direction. The ink cartridges 82 to 87 are mounted in the carriage 80. During the movement in the main scan direction, the ink is ejected from the nozzles (described later) arranged in the recording head 90 to the recording medium P (typically, printing paper). In this manner, dot recording is performed on the recording medium P or dots are recorded or printed on the recording medium P. In this manner, the movement in the main scan direction of the recording head 90 and the ejection of the ink are referred to as a main scan. Performing a main scan one time is referred to as a "main scan pass" or merely as a "pass". A "main scan pass" may refer to movement of the carriage in a first direction (e.g., forward) and/or movement in a second (e.g., backward) direction. The first and second directions are opposite directions in the main scan direction.

The paper feeding roller 75 is connected to the paper feeding motor 74. During recording, the recording medium P is inserted onto the paper feeding roller 75. If the carriage 80 moves to an end portion in the main scan direction, the control unit 61 rotates the paper feeding motor 74. As a result, the paper feeding roller 75 also rotates, and moves the recording medium P. A relative movement between the recording medium P and the recording head 90 is referred to as a sub-scan, and a relative movement direction is referred to as a "sub-scan direction". A sub-scan driving mechanism may include the paper feeding motor 74 and the paper feeding roller 75. The sub-scan direction is a direction (orthogonal direction) that is perpendicular to the main scan direction. However, the sub-scan direction is not required to be always orthogonal to the main scan direction, and may intersect the main scan direction.

In addition, in general, a main scan operation and a sub-scan operation are performed alternately or at different times. In addition, as a dot recording operation, it is possible to perform at least one of a unidirectional recording operation which records dots only during the main scan of a forward path, and a bidirectional recording operation which records dots during the main scans in both directions of the forward path and a backward path. In the main scan of the forward path and the main scan of the backward path, the direction of the main scan is merely reversed. Hereinafter, the forward path and the backward path will be described without being distinguished as long as there is no particular necessity. Either may be referred to as a main scan.

The image processing unit 20 may be integrated with or integrally configured with the dot recording unit 60. In addition, the image processing unit 20 may be separate from or configured separately from the dot recording unit 60. The image processing unit 60 may be implemented or built in a computer (not illustrated). In this case, the image processing unit 20 may be implemented by the CPU as printer driver software (e.g., a computer program) stored in a memory of the computer.

Figure 2:
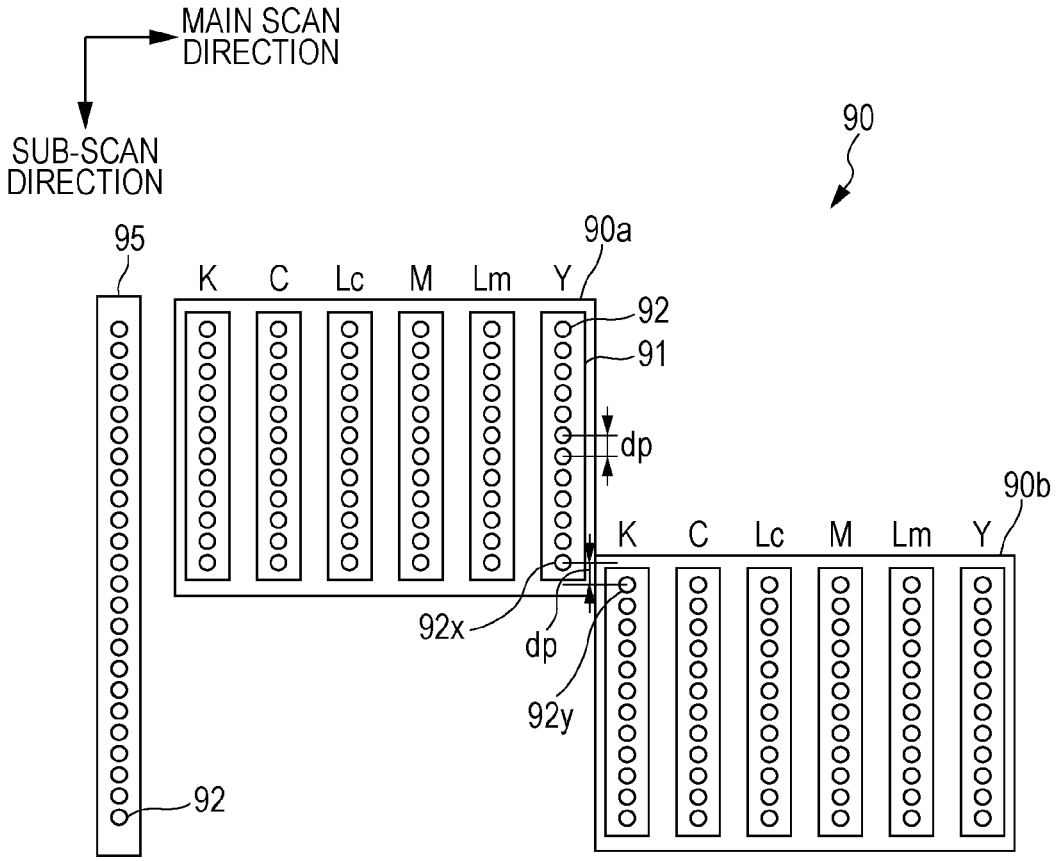
FIG. 2 is an explanatory diagram illustrating an example of a configuration of a nozzle row of a recording head.

FIG. 2 is an explanatory diagram illustrating an example of a nozzle row configuration of the recording head 90. In addition, in FIG. 2, two recording heads 90 are illustrated. However, the recording head 90 may be one piece and may be two or more pieces. The two recording heads 90*a* and 90*b* respectively include nozzle rows 91 for each color. Each nozzle row 91 includes a plurality of nozzles 92 which are lined up or arranged in the sub-scan direction at a constant nozzle pitch dp. A nozzle 92*x* located at an end portion of the nozzle row 91 of the first recording head 90*a* is shifted in the sub-scan direction by the same distance as the nozzle pitch dp of the nozzle row 91, from a nozzle 92*y* located at an end portion of the nozzle row 91 of the second recording head 90*b*. In this case, the nozzle row for one color, of the two recording heads 90*a* and 90*b* has the same value as a nozzle row 95 (illustrated on a left-hand side of FIG. 2) which has two times the number of nozzles for one color of one recording head 90. In the following description, a method of performing the dot recording of one color using the same nozzle row 95 will be described. In addition, in one embodiment, the nozzle pitch dp and a pixel pitch on the recording medium P are the same. However, the nozzle pitch dp can also be a multiple of the pixel pitch on the recording medium P. In the case of the latter, so-called interlacing recording (an operation of performing an operation of recording the dots by a pass after the second pass, in such a manner that a dot gap between the main scan lines recorded in the first pass is filled) is performed. The nozzle pitch dp may be a value (0.035 mm) corresponding to, for example, 720 dpi.

Figure 3:
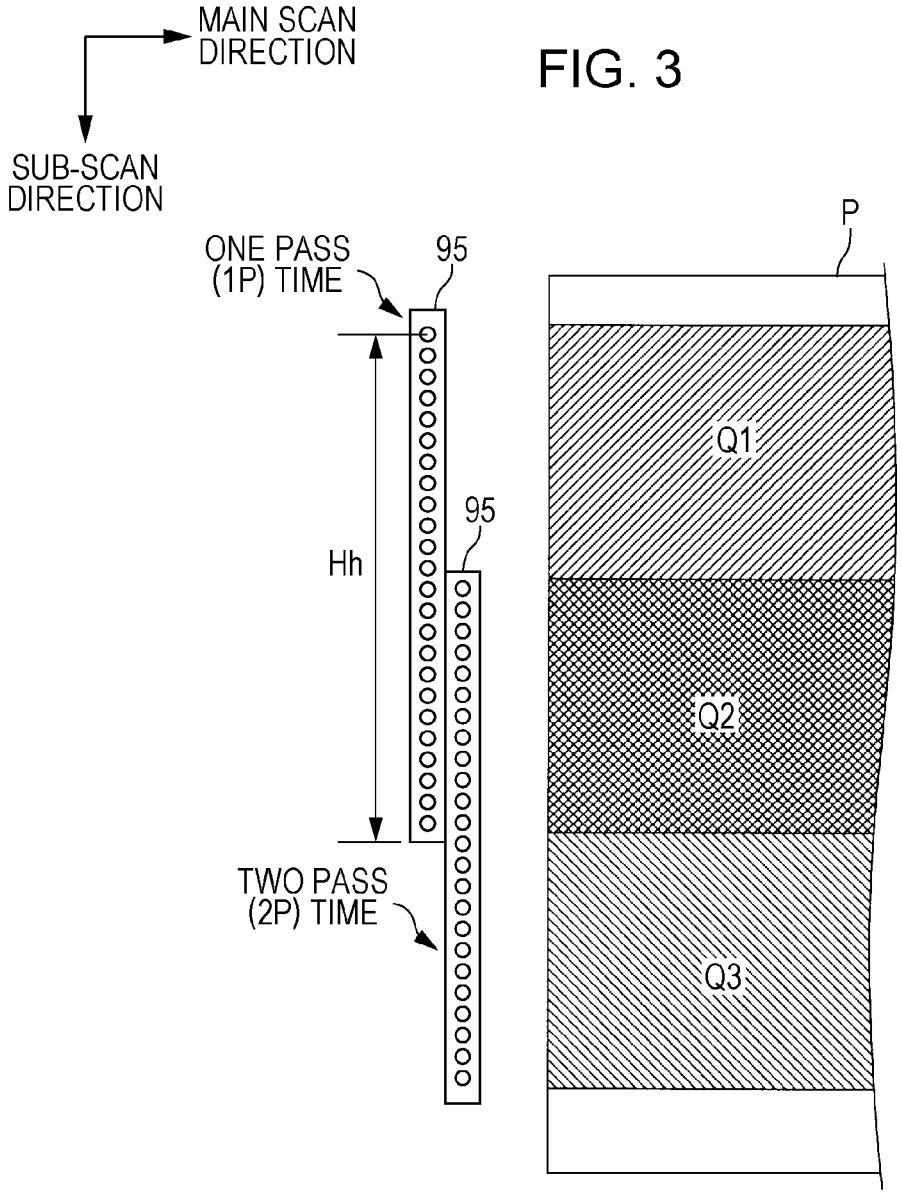
FIG. 3 is an explanatory diagram illustrating both a position of a nozzle row of two main scan passes of dot recording and a recording area at the position.

FIG. 3 is an explanatory diagram illustrating positions of a nozzle row 95 for two main scan passes of dot recording and a recording area at the positions. In the following description, a case where dots are formed on all the pixels of the recording medium P using ink (for example, cyan ink) of one color will be described as an example. In the present specification, a dot recording operation where the dots on each main scan line are completed or formed by N (N is an integer equal to or greater than two) main scan passes is referred to as "multi-pass recording". In the present embodiment, N, which is the number of passes of multi-pass recording, is 2. In the first pass (1P) and the second pass (2P), the position of the nozzle row 95 is shifted in the sub-scan direction by a distance corresponding to half of a head height Hh. Here, "the head height Hh" means a distance which is represented by M×dp (M is the number of nozzles of the nozzle row 95 and dp is the nozzle pitch).

In the first pass, the dot recording is performed in 50% of all pixels in an area Q1 . The area Q1 configured with or includes the main scan lines through which the nozzles of an upper half of the nozzle row 95 penetrate or correspond in the recording medium P. In the first pass, dots are recorded in 50% of all pixels in an area Q2. The area Q2 is configured with or includes main scan lines through which the nozzles of a lower half of the nozzle row 95 penetrate or correspond in the recording medium P. In other words, dots are recorded (dot recording is performed) in half of the pixels in the area Q1 and in the area Q2 during the first pass. However, depending on the image data, a dot may not actually be placed in some of the pixels. The dot recording process places dots in the associated pixels when the data indicates that a dot should be placed.

In the second pass, the dot recording is performed in pixels where the dots are not formed in the first pass of the area Q2. In the second pass, the nozzles of the upper half of the nozzle row 95 are used to record dots in the pixels that did not receive dots during the first pass. In the second pass, dot recording is also performed in of 50% of all pixels in an area Q3. The area Q3 is configured with or includes main scan lines through which the nozzles of the lower half of the nozzle row 95 penetrate or correspond in the recording medium P.

Thus, 50% of the area Q2 is recorded by the first pass and 50% of the area Q2 is recorded by the second pass. As a result, dots are recorded for a total of 100% of the pixels in the area Q2. In addition, in the third pass, the dot recording is performed in the rest of the pixels of the area Q3 and dot recording is performed in 50% of the pixels of the area Q4 (not illustrated) next thereto.

In addition, it is assumed that the image (beta image) in which dots are formed on all the pixels of the recording medium P is formed on the recording medium P, but the recorded image (printed image) which is represented by actual dot data includes the pixels which actually form dots in the recording medium P and the dots which are not actually formed in the recording medium P. That is, whether or not the dots on each pixel of the recording medium P are actually formed is determined by the dot data which is generated by the halftone processing. In the present specification, the term "dot recording" means "dot is formed or not formed". In addition, the term "dot recording is performed" is used as a term which means "it is responsible for dot recording", regardless of whether or not the dots on the recording medium P are actually formed.

Figure 4:
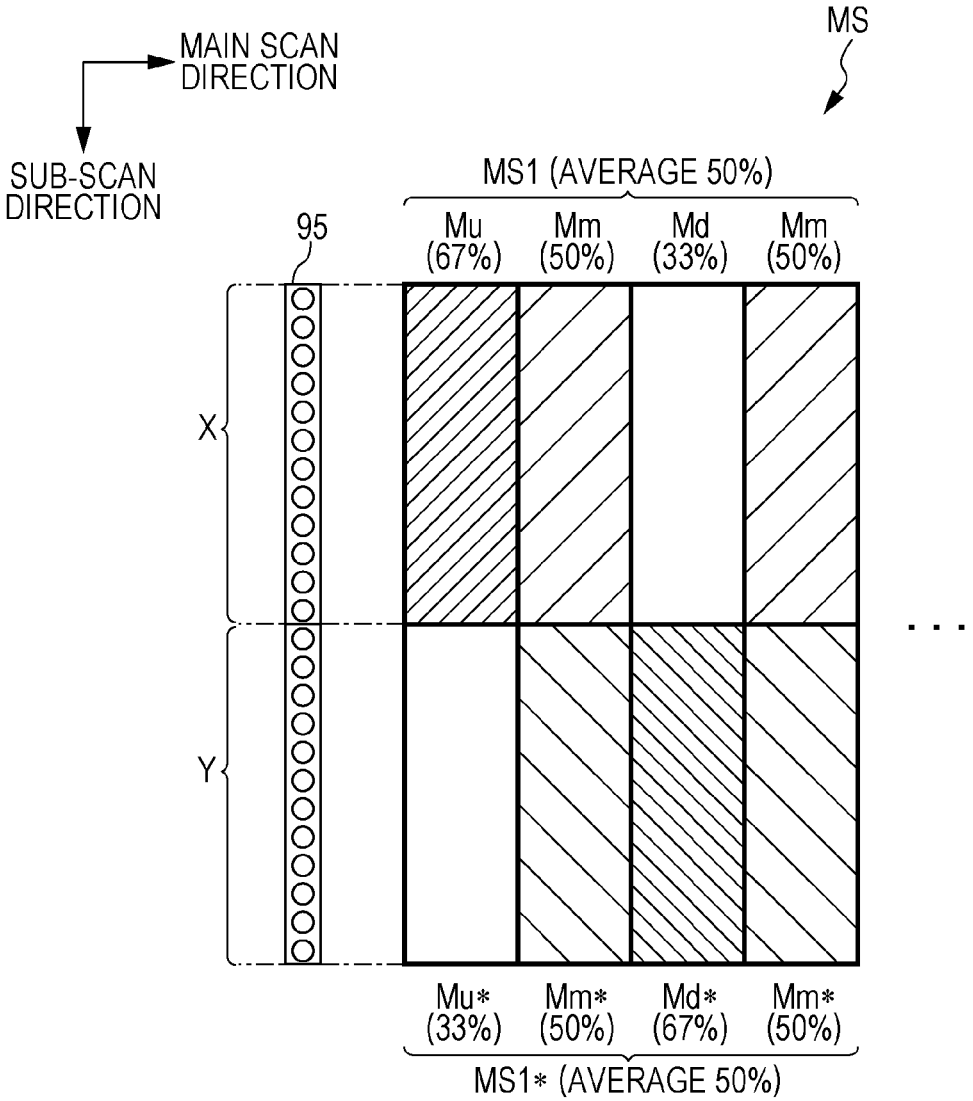
FIG. 4 is an explanatory diagram illustrating an example of a mask for forming a dot recording pattern in each pass.
Figure 5:
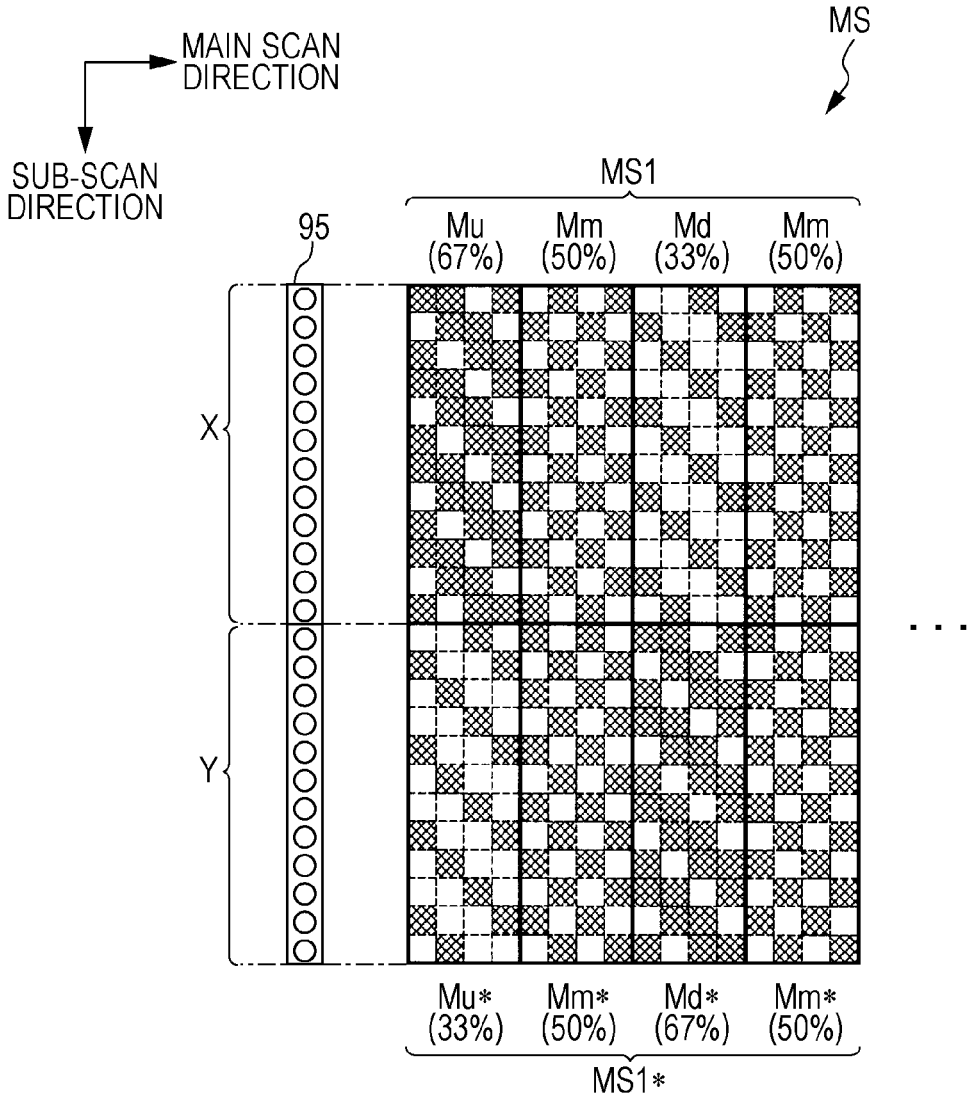
FIG. 5 is an explanatory diagram illustrating a specific example of the mask in FIG. 4.

FIG. 4 is an explanatory diagram illustrating a mask for forming a dot recording pattern in each pass, and FIG. 5 is an explanatory diagram illustrating a specific example of the mask in FIG. 4. The mask MS is configured with a first mask MS1 which may be assigned with respect to the nozzle group X of the upper half of the nozzle row 95, and a second mask MS1* which may be assigned with respect to the nozzle group Y of the lower half of the nozzle row 95. The mask MS is repeatedly arranged along the main scan direction on the recording medium P.

The first mask MS1 is configured by or includes four mask areas Mu, Mm, Md and Mm of rectangular shape which are sequentially separated in each section with a constant length of an amount of a plurality of dots lined up in the main scan direction. The first mask area Mu is an area in which the nozzle group X of the upper half has a dot rate (67% in the present example), which represents a rate responsible for the dot recording, more than 50%, within the area. The third mask area Md is an area in which the dot rate (33% in the present example) of the nozzle group X of the upper half is less than 50%, within the area. The dot rate of the first mask area Mu and the dot rate of the third mask area Md are set in such a manner that the average of the dot rates is 50%. The second and fourth mask areas Mm are areas in which the dot rate of each nozzle of the upper head X in the area is 50%. Thus, the dot rate in the area of the first mask MS1 becomes an average of 50%. In addition, the first mask MS1 is repeatedly arranged in the main scan direction. As a result or arranging the first mask MS1 in this manner, the dot rate of each area lined up in the main scan direction is changed gradually and periodically. In addition, the dot rate of each of the four areas is not limited thereto, and the dot rate of each area may be changed gradually and periodically. An average of the dot rate may be set so as to be 50% in one example.

The first mask area Mu, by way of example and not limitation, as illustrated in FIG. 5, is set as one area which is divided into 4×12 pixels, and is configured by setting two thirds of all the pixels in the area as the pixels (hereinafter, referred to as "responsible pixel") responsible for the dot recording, and by setting a third of the rest pixels as the pixels (hereinafter, referred to as "non-responsible pixel") not responsible for the dot recording. In other words, the responsible pixels are the pixels that are being recorded. As previously stated, however, some of the responsible pixels may not actually receive dots because the placement of dots is dependent on the halftone processing data. The non-responsible pixels, as discussed below, may be recorded during a subsequent main pass.

In addition, the third mask area Md, for example, as illustrated in FIG. 5, is also configured by setting a third of all the pixels in the area as responsible pixels, and by setting two thirds of the rest pixels as non-responsible pixels. Furthermore, the second and fourth mask areas Mm, for example, as illustrated in FIG. 5, are configured by setting half of all the pixels in the area as responsible pixels, and by setting a half of the rest pixels as non-responsible pixels. In addition, the responsible pixels and the non-responsible pixels be set so as to be respectively distributed without deviation in the area. In addition, also in an area with the same dot rate, the arrangement position of the responsible pixels and the non-responsible pixels is not necessarily the same and can be set at random. In other words, the locations of the responsible pixels in the first Mm area may be different from the locations of the responsible pixels in the second Mm area in the present example.

The second mask MS1*, as illustrated in FIG. 4, is configured by or includes four mask areas Mu*, Mm*, Md* and Mm* which are sequentially separated along the main scan direction so as to coincide with a boundary along the sub-scan direction of each mask area of the first mask MS1. A fifth mask area Mu*, as illustrated in FIG. 4, is an area with a rate (33% in the present example) which is set in such a manner that the dot rate of the nozzle group Y of the lower half in the area is brought into a complementary relationship with the first mask area Mu. Specifically, the fifth mask area Mu*, as illustrated in FIG. 5, is set in such a manner that the non-responsible pixels in the first mask area Mu become the responsible pixels and the responsible pixels become the non-responsible pixels.

In addition, a seventh mask area Md*, as illustrated in FIG. 4, is an area with a dot rate (67% in the present example) which is set in such a manner that the dot rate of the nozzle group Y of the lower half in the area is brought into a complementary relationship with the third mask area Md. Specifically, the seventh mask area Md*, as illustrated in FIG. 5, is set in such a manner that the non-responsible pixels in the third mask area Md become the responsible pixels and the responsible pixels become the non-responsible pixels.

In the same manner, sixth and eighth mask areas Mm*, as illustrated in FIG. 4, are also areas with a dot rate (50% in the present example) which is set in such a manner that the dot rate of the nozzle group Y of the lower half in the area is brought into the complementary relationship with the second and fourth mask areas Mm. Specifically, the sixth and eighth mask areas Mm*, as illustrated in FIG. 5, are set in such a manner that the non-responsible pixels in the second and fourth mask areas Mm become the responsible pixels and the responsible pixels become the non-responsible pixels.

The mask MS1 and the mask MS1* each include four areas in one example. Each area may be rectangular in shape and may correspond to 4×12 pixels. The dimensions and number of pixels can be different however. Further, the masks MS1 and MS1* are arranged such that the dot rates of the areas in the MS1 mask complement the dot rates of the areas in the MS1* mask. Stated differently, the percentage of responsible pixels sums to 100% in one example for complementary areas (e.g., Mu and Mu*, etc.).

Figure 6:
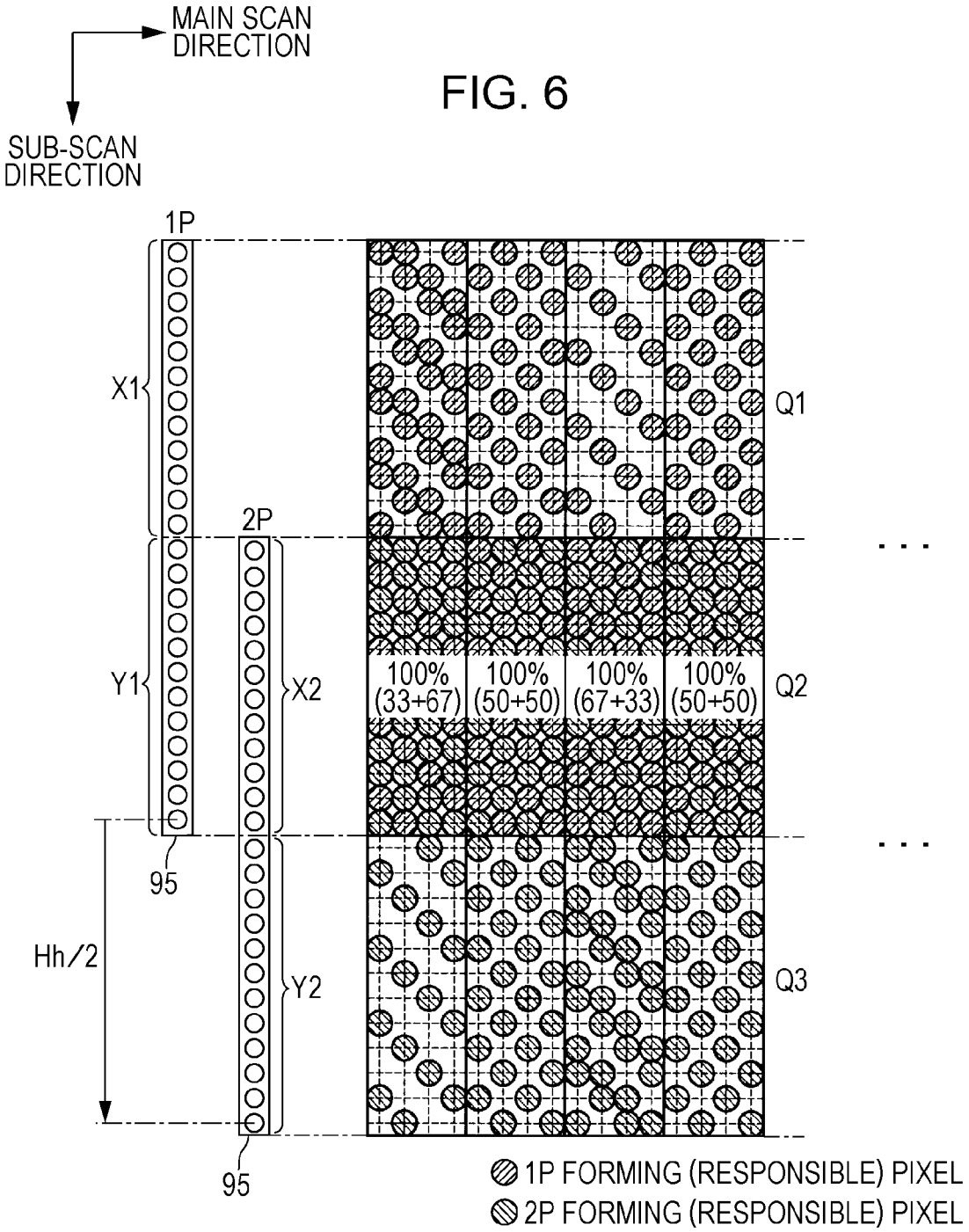
FIG. 6 is an explanatory diagram illustrating a state where dot recording is performed by a first pass and a second pass.

FIG. 6 is an explanatory diagram illustrating a state where dot recording is performed by a first pass 1P and a second pass 2P. In the first pass, the nozzle row 95 of the first pass illustrated in the left-hand side of FIG. 6 moves in the main scan direction. In an area Q1 illustrated in the right-hand side of FIG. 6, the dot recording responding to the first mask MS1 (FIG. 5) assigned in the nozzle group X1 of the upper half of the mask MS illustrated in FIG. 4 is performed. In addition, in an area Q2, the dot recording responding to the second mask MS1* (FIG. 6) assigned in the nozzle group Y1 of a lower half of the mask MS is performed in the first pass. In addition, the responsible pixels of the first pass are illustrated by a circle with right diagonal upward hatched lines.

In the second pass, the nozzle row 95 is shifted by an amount of half (12 pixels in the present example) of the head height Hh (24 pixels in the present example) in the sub-scan direction from the position of the first pass. The nozzle row 95 is then moved in the main scan direction. As a result, in the area Q2, the dot recording responding to the first mask MS1* assigned in the nozzle group X2 of the upper half of the mask MS is performed. In addition, in area Q3, the dot recording responding to the second mask MS1* assigned in the nozzle group Y2 of the lower half of the mask MS is performed. In addition, the responsible pixels of the second pass are illustrated by a circle with left diagonal upward hatched lines. As a result, the dot recording of all the pixels in the area Q2 is completed. The dot recording of all the pixels in the area Q2 is completed in two passes in this example.

In the same manner, also in the third or subsequent passes, the dot recording according to the mask MS is performed. In this way, moving the nozzle row 95 in the main scan direction and ejecting the ink, and relatively moving the recording medium P in the sub-scan direction are alternately repeated several times. Thereby the dot recording on the recording medium P is completed. In addition, since the dot recording is not performed at some positions of the pixels in the area Q1 in the upper portion, a printing target area (recording target area) in which the image is actually printed (recorded) is at or lower than the area Q2. This is similarly applied to the other embodiments described later.

In addition, in the description for FIG. 6, the mask MS also moves as the nozzle row 95 moves in the sub-scan direction. However, the mask MS may be arranged repeatedly in a tiled form in the main scan direction and the sub-scan direction on the recording medium P, and thereby the responsible pixels may be determined. In a case of the latter, the pixel with the hatched lines in FIG. 5 is treated as indicating a pixel which performs the dot recording in the odd-numbered main scan passes, and the pixel without the hatched lines is treated as indicating a pixel which performs the dot recording in the even-numbered main scan passes.

The dot recording operation described using FIGS. 3 to 6 is realized by a rasterizing operation performed by the rasterizer 44. That is, the dot recording operation is independent of the actual printing target image, and is an operation of determining in which pass and by which nozzle the dot recording of each pixel on each main scan lines is performed. Whether or not the dot is actually formed at each pixel is determined according to the printing target image. In addition, the mask MS (FIGS. 3 and 4) used by the rasterizing operation may be stored in a non-volatile memory device such as the ROM 51 or the EEPROM 53. In addition, the first mask MS1 and the second mask MS1* which configure the mask MS may be configured so as to be separately stored in a memory.

In the present embodiments, the dot recording of each area is completed by the dot recording performed by the two passes. At this time, the mask MS which is used by the dot recording in each pass is set in such a manner that a dot rate is changed repeatedly, gradually and periodically in an arrangement sequence of a plurality of sections separated by a section of a constant length of a plurality of pixels lined up in the main scan direction. In a case where the dot recording is performed using the mask, the main scan line is divided for each constant section, the dot rate is changed gradually and periodically over the plurality of sections, and thus it is possible to suppress the banding along the main scan direction from occurring.

In addition, the dot rate is changed gradually and periodically for each section, and thereby it is possible to suppress a rapid change of the dot rate for each section along the main scan direction, and thus it is possible to prevent the banding from easily standing out due to rapid change of dot rate occurring at the sections that are adjacent to each other. In addition, since the mask is set in such a manner that all the nozzles do not eject the inks simultaneously, it is possible to suppress a concern that a landing position of the ink ejected by an airflow occurring according to the ink ejected from the nozzle is different from the assumed position, compared to a case where the inks are simultaneously ejected from all the nozzles.

Figure 7:
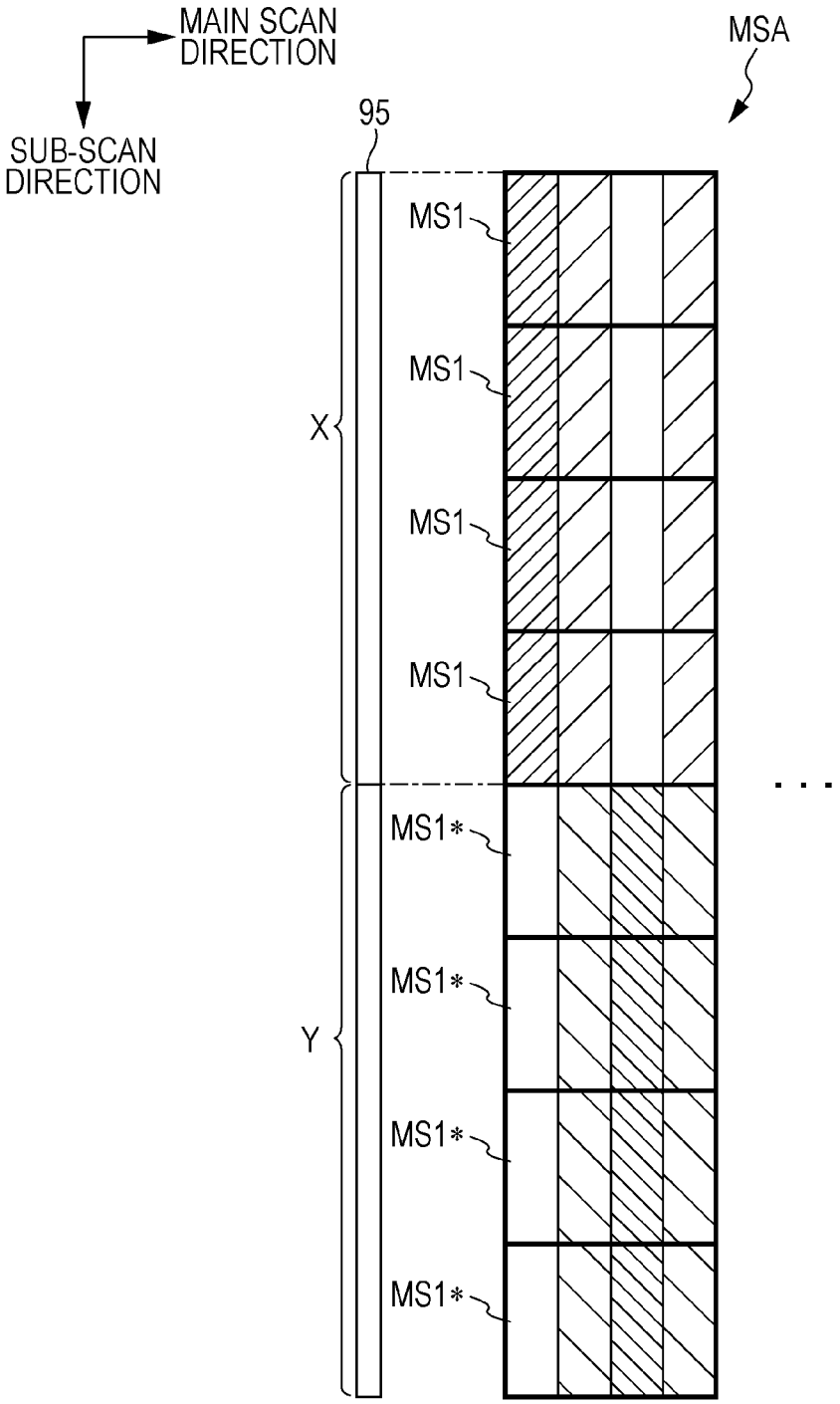
FIG. 7 is an explanatory diagram illustrating another example of a mask for forming a dot recording pattern in each pass.

FIG. 7 is an explanatory diagram illustrating another example of a mask for forming a dot recording pattern in each pass. The mask MS of FIG. 4 illustrates a configuration in which one piece of the first mask MS1 is arranged with respect to the nozzle group X of the upper half of the nozzle row 95, and one piece of the second mask MS1* is arranged with respect to the nozzle group Y of the lower half of the nozzle row 95.

In contrast, a mask MSA of FIG. 7 has a configuration in which a plurality of the first masks MS1 is arranged along a nozzle height direction (sub-scan direction) with respect to the nozzle group X of the upper half, and in the same manner, has a configuration in which a plurality of the second masks MS1* is arranged along the nozzle height direction, also with respect to the nozzle group Y of the lower half. In this case, the first mask MS1 and the second mask MS1* are separately stored one by one in the non-volatile memory device, and they are repeatedly used, and thereby the mask MSA illustrated in FIG. 7 may be configured so as to be realized. In this way, there is an advantage that an amount of mask data is reduced.

Figure 8:
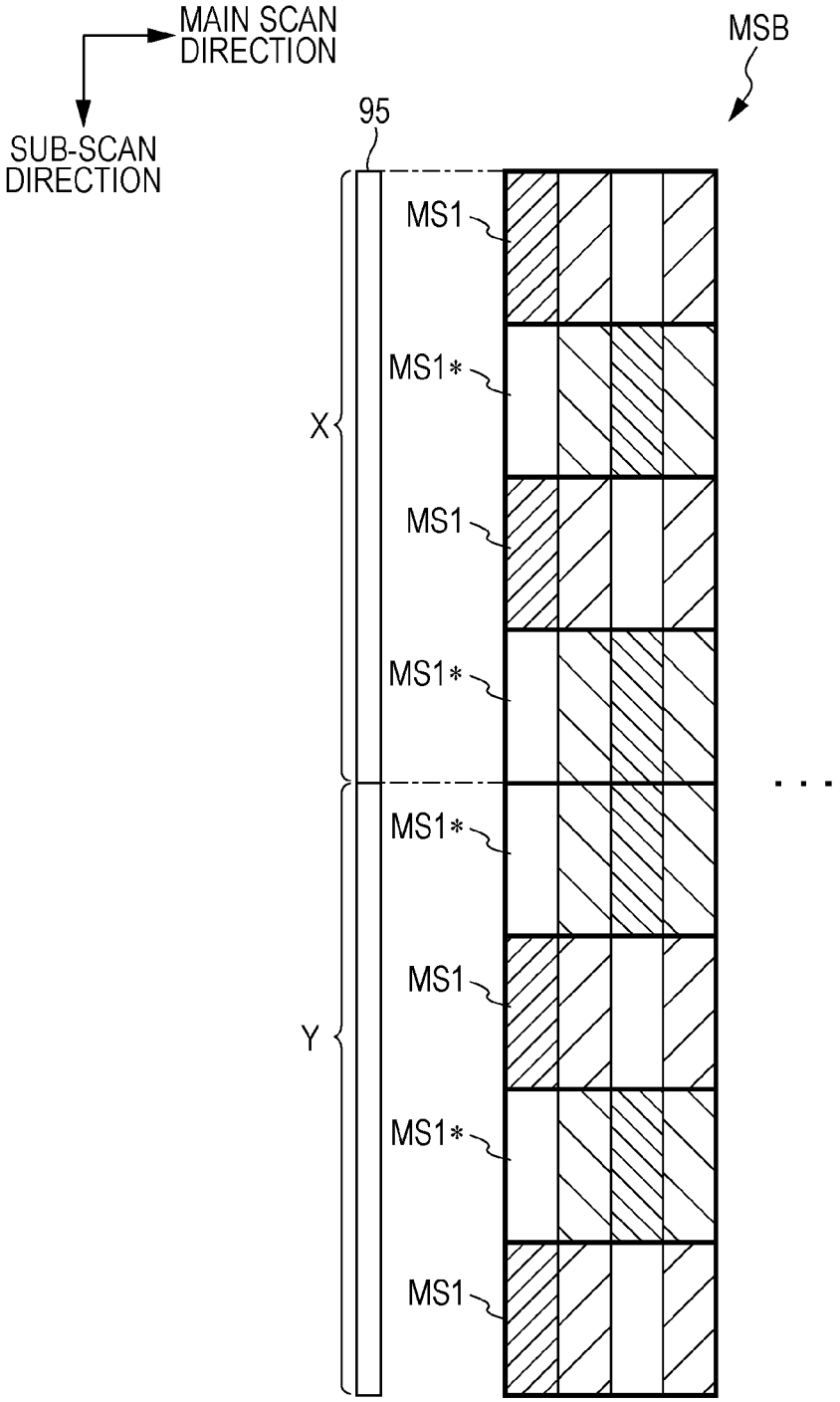
FIG. 8 is an explanatory diagram illustrating another example of the mask for forming the dot recording pattern in each pass.

FIG. 8 is an explanatory diagram illustrating another example of the mask for forming the dot recording pattern in each pass. A mask MSB of FIG. 8 has a configuration in which the first mask MS1 and the second mask MS1*, as one pair, are arranged alternately and plurally or repeatedly in the sub-scan direction with respect to the nozzle group X of the upper half, and the second mask MS1* and the first mask MS1, as one pair, are arranged alternately and plurally or repeatedly in the sub-scan direction with respect to the nozzle group Y of the lower half. In the mask MSB, in the same manner as the mask MSA of FIG. 7, there is an advantage that an amount of the mask data which is stored in the non-volatile memory device is reduced. In addition, because the same masks are not arranged along the sub-scan direction like the mask MSA of FIG. 7 and different masks are alternately arranged along the sub-scan direction, there is an effect that there is division into sections each having a constant length along the sub-scan direction, and compared to the mask MSA of a first modification example, it is possible to suppress the banding along the sub-scan direction from occurring.

Figure 9:
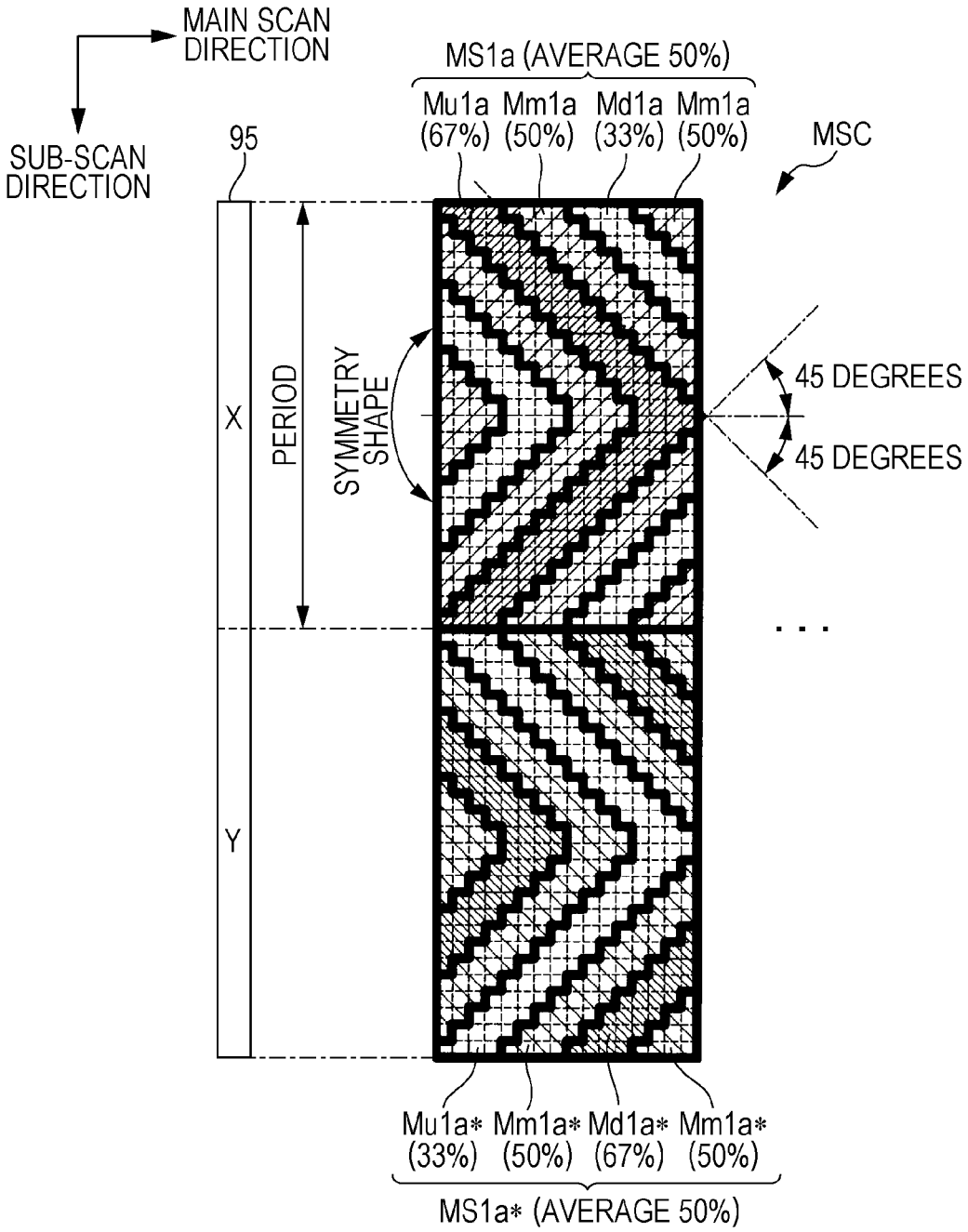
FIG. 9 is an explanatory diagram illustrating an example of a mask for forming a dot recording pattern in each pass.

FIG. 9 is an explanatory diagram illustrating a mask for forming a dot recording pattern in each pass. In one embodiment, N is the number of passes of the multi-pass recording and may be 2. In the mask MS illustrated in FIG. 4 described above, the mask areas in which dot rates different from each other are assigned are divided by boundaries in parallel with each other in the sub-scan direction. In contrast, in a mask MSC illustrated in FIG. 9 by way of example, the mask areas in which dot rates different from each other are assigned are formed so as to have zigzag shapes. In other words, the boundaries of the mask areas of the mask MSC have zigzag shapes, or the mask MSC has areas formed in the zigzag shapes in such a manner that the rate at which the nozzle group is responsible for the dot recording is changed in each predetermined range along a direction which intersects with the main scan direction and the sub-scan direction.

The mask MSC is configured with a first mask MS1a corresponding to the nozzle group X of the upper half, and a second mask MS1a* corresponding to the nozzle group Y of the lower half. The second mask MA1a* has complementary relationship with the first mask MS1a. The first mask MS1a, in the same manner as the first mask MS1 (FIG. 4), is divided into four types of mask areas Mu1a, (dot rate is 67%), Mm1a (dot rate is 50%), Md1a (dot rate is 33%), and Mm1a (dot rate is 50%). However, in such four mask areas Mu1a, Mm1a, Md1a, and Mm1a, a left and right boundary (that is, a boundary along the sub-scan direction) of each mask area has a linear shape with a tilt of 45 degrees with respect to the main scan direction and the sub-scan direction, and has a shape of mirror symmetry with respect to a center in the sub-scan direction. The second MS1a* has four mask areas Mu1a*, Mm1a*, Md1a*, and Mm1a* which have a complementary relationship with the four mask areas Mu1a, Mm1a, Md1a, and Mm1a of the first mask MS1a. A left and right boundary of each mask area has a linear shape with a tilt of 45 degrees with respect to the main scan direction and the sub-scan direction, and has a shape of mirror symmetry with respect to the center in the sub-scan direction.

In the same manner as the mask MS1 (FIG. 4), the mask MSC is also set in such a manner that the dot rate for each section of a constant length of an amount of a plurality of pixels lined up in the main scan direction is changed repeatedly, gradually and/or periodically. In a case where the dot recording is performed using the mask MSC, the main scan line is divided for each constant section, the dot rate is changed gradually and periodically over the plurality of sections, and thereby it is possible to suppress the banding along the main scan direction from occurring. In addition, the dot rate for each section is changed gradually and periodically, and thereby it is possible to suppress a rapid change of the dot rate for each section along the main scan direction. It is possible to suppress the banding from easily standing out due to the rapid change of the dot rate at the sections adjacent to each other.

In addition, in the mask MSC, the boundary of the mask area with the dot rates different from each other has a linear shape with a tilt of 45 degrees so as not to be a linear shape along the main scan direction and the sub-scan direction. Thus, division into a plurality of sections for each constant length can be done gradually and periodically, along not only the main scan direction but also the sub-scan direction. In this way, it is also possible to suppress the banding along the sub-scan direction from occurring. In addition, since the mask is set in such a manner that all the nozzles do not perform the dot recording simultaneously, it is possible to suppress a concern that a landing position of the ink ejected by an airflow occurring according to the ink ejected from the nozzle is different from the assumed position, compared to a case where the inks are simultaneously ejected from all the nozzles.

In addition, in the above description, a case where the boundary of each section is a linear shape with a tilt of 45 degrees is described as an example, but the boundary is not limited thereto, and can be a linear shape with an arbitrary angle with respect to the main scan direction and the sub-scan direction. In addition, it is possible to arrange in the same manner as the mask of the example described in FIGS. 7 and 8. Such an arrangement can also be applied to the other embodiments described in the following description.

Figure 10:
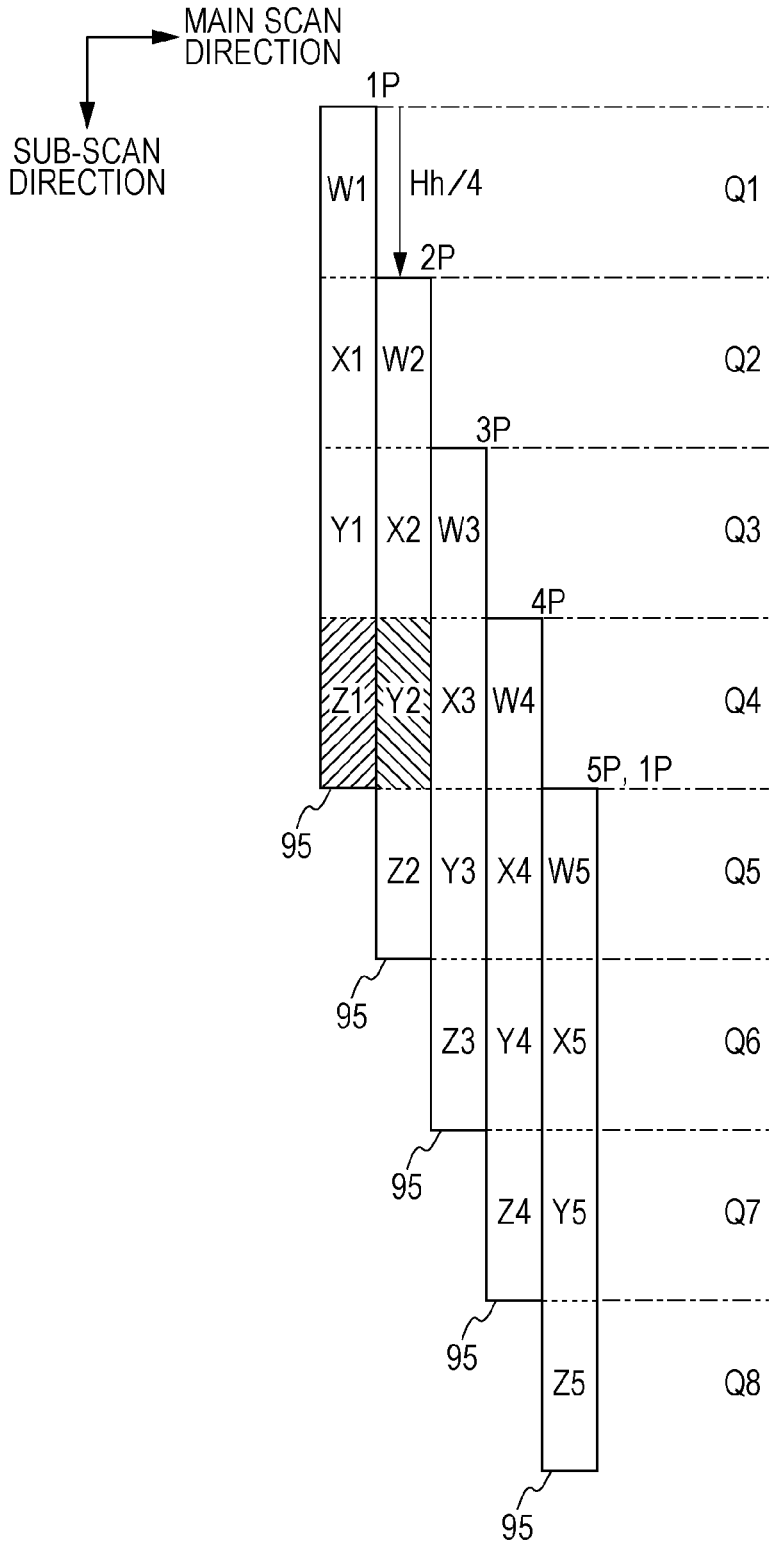
FIG. 10 is an explanatory diagram illustrating both positions of a nozzle row of four main scan passes and a recording area at the positions

FIG. 10 is an explanatory diagram illustrating both positions of the nozzle row 95 for four main scan passes and a recording area at the positions. As previously described, the dot recording at the position of all the pixels on each main scan line is completed by two passes or by performing a pass two times. In FIG. 10, the dot recording at the position of all the pixels on each main scan line is completed by performing four passes. That is, N, which is the number of passes of multi-pass recording, is 4 in one example.

For example, in the first and second passes, the dot recording at the odd-numbered pixel positions in the main scan direction may be performed, and in the third and fourth passes, the dot recording at the even-numbered pixel positions may be performed. In addition, in moving the recording medium P toward the sub-scan direction, which is performed after each pass, the recording medium P moves to a lower side in the sub-scan direction by a distance equal to a quarter of the head height Hh.

For example, in the area Q4, the dot recording is performed in 50% of the odd-numbered pixels in the first pass, and the dot recording is performed in the rest of the odd-numbered pixels in the second pass. Then, the dot recording is performed in 50% of the even-numbered pixels in the third pass, and the dot recording is performed in the rest of the even-numbered pixels in the fourth pass. Thus, in the area Q4, 50% (25% with respect to all pixels) of the odd-numbered pixels are recorded in the first pass and 50% (25% with respect to all pixels) are recorded in the second pass. Similarly, the even-numbered pixels are recorded by 50% (by 25% with respect to all pixels) in the third and fourth passes. More specifically, in the area Q4, 50% (25% with respect to all pixels) of the even-numbered pixels are recorded in the third pass and 50% (25% with respect to all pixels) are recorded in the fourth pass. In this manner, recording in 100% of the pixels is performed in the area Q4 (and in other areas). This example is not limiting. The even-numbered pixels may be recorded during the first and second passes (or first and third or first and fourth) while the odd-numbered pixels may be recorded during the other passes of the N passes.

Figure 11:
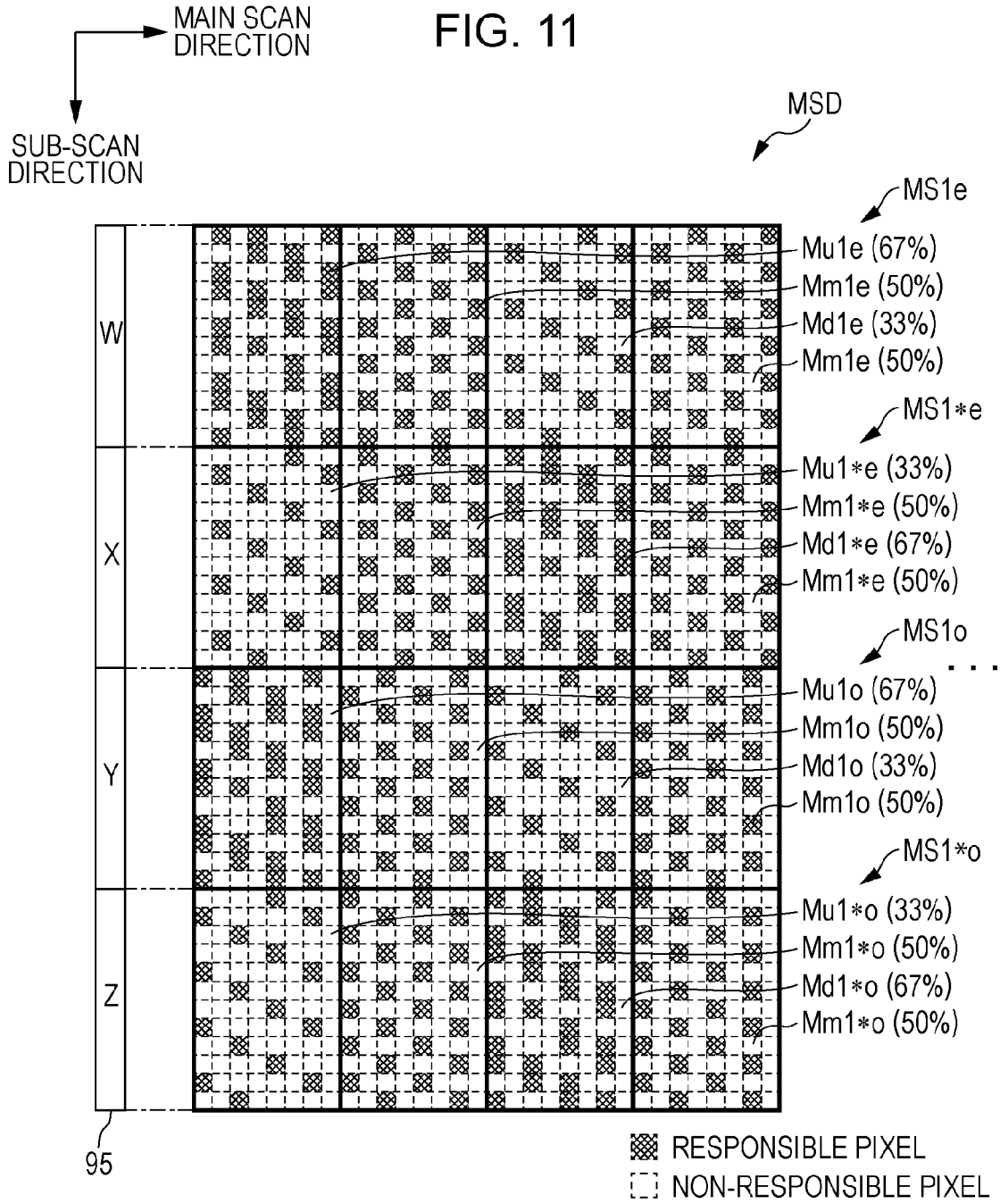
FIG. 11 is an explanatory diagram illustrating an example of the mask for forming a dot recording pattern in each pass.

FIG. 11 is an explanatory diagram illustrating a mask for forming a dot recording pattern in each pass. The mask MSD is configured with a first mask area MS1e which is assigned with respect to a first nozzle group W from above, a second mask area MS1*e which is assigned with respect to a second nozzle group X from above, a third mask area MS1o which is assigned with respect to a third nozzle group Y from above, and a fourth mask area MS1*o which is assigned with respect to a fourth nozzle group Z. The nozzles in the nozzle height Hh of the nozzle row 95 are divided into four groups in this example. The first mask area MS1e and the second mask area MS1*e are masks which are in charge of or used for the dot recording of the even-numbered pixels in the main scan direction, and positions of the dot recording in the even-numbered pixels have a complementary relationship with each other. In the same manner, the third mask area MS1o and the fourth mask area MS1*o are masks which are in charge of or used for the dot recording of the odd-numbered pixels in the main scan direction, and positions of the dot recording in the odd-numbered pixels have a complementary relationship with each other as illustrated in FIG. 11.

Figure 12A:
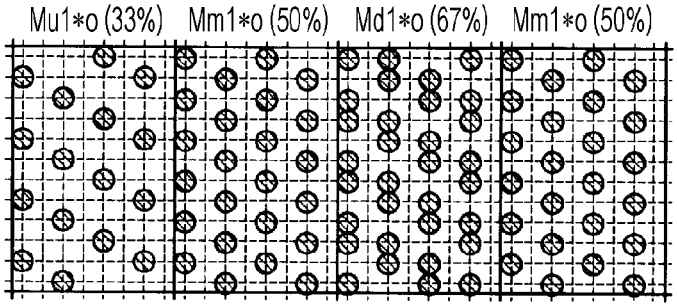
FIGS. 12A to 12E are explanatory diagrams illustrating a state where dot recording is performed within one area in the first to fourth passes.
Figure 12B:
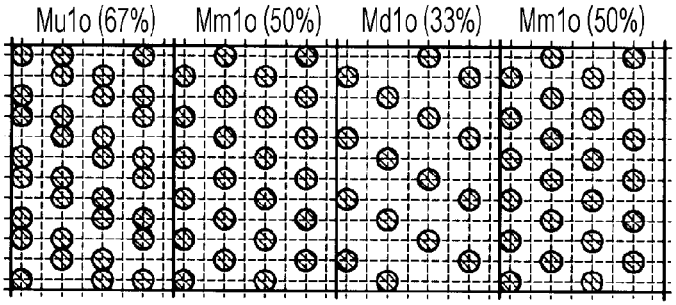

FIGS. 12A to 12E are explanatory diagrams illustrating a state where dot recording is performed within area Q4 in the first to fourth passes. In the first pass 1P, as illustrated in FIG. 12A, according to the fourth mask MS1*o which is assigned to the fourth nozzle group Z1 from the top of the mask MSD illustrated in FIG. 11, the dot recording of the odd-numbered pixels in the main scan direction is performed. In addition, in the second pass 2P, as illustrated in FIG. 12B, according to the third mask MS1o which is assigned to the third nozzle group Y2 from the top of the mask MSD illustrated in FIG. 11, the dot recording of the odd-numbered pixels in the main scan direction is performed. As a result, the dot recording of the pixels of the odd number row(s) in the main scan direction of the area Q4 is completed during the first and second passes. In addition, the responsible pixels formed in the first and second passes are illustrated by a circle with left diagonal upward hatched lines.

Figure 12C:
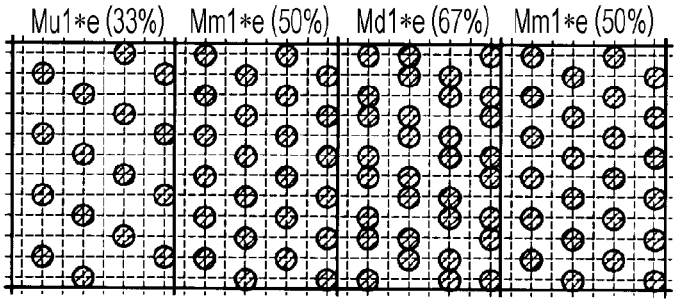
Figure 12D:
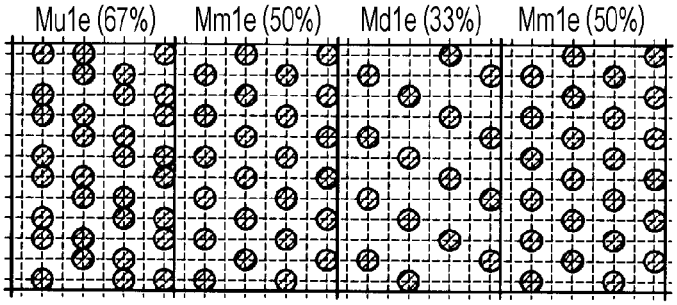
Figure 12E:
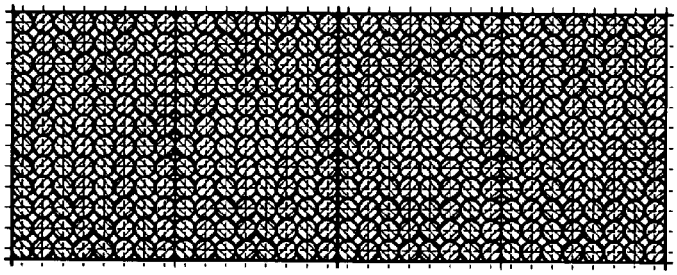

In the third pass 3P, as illustrated in FIG. 12C, according to the second mask MS1*e which is assigned to the second nozzle group X3 from the top of the mask MSD illustrated in FIG. 11, the dot recording of the even-numbered pixels in the main scan direction is performed. In addition, in the fourth pass 4P, as illustrated in FIG. 12D, according to the first mask MS1e which is assigned to the first nozzle group W4 from the top of the mask MSD illustrated in FIG. 11, the dot recording of the even-numbered pixels in the main scan direction is performed. As a result, the dot recording of the pixels of the even number row(s) in the main scan direction of the area Q4 is completed during the third and fourth passes. In addition, the responsible pixels formed in the third and fourth passes are illustrated by a circle with right diagonal upward hatched lines. As a result of the above, as illustrated in FIG. 12E, the dot recording of all the pixels of the area Q4 is completed by four passes or by performing a pass four times and causing relatively movement in the sub-scan direction between each of the passes.

In addition, in the same manner, also in the fifth or subsequent passes, in the (4q+1)th and (4q+2)th (q is an integer equal to or greater than 1) passes, the dot recording is performed by the third and fourth masks MS1o and MS1*o according to the odd number row in the main scan direction, and in the (4q+3)th and (4q+4)th passes, the dot recording is performed by the first and second masks MS1e and MS1*e according to the even number row in the main scan direction. In this way, a main scan pass and a sub-scan pass are alternately and repeatedly performed several times. In this manner, the dot recording on the recording medium P is completed.

Also it is possible to suppress the banding along the main scan direction from occurring. Since the mask is set in such a manner that all the nozzles do not eject the inks simultaneously, it is possible to suppress a concern that a landing position of the ink ejected by an airflow occurring according to the ink ejected from the nozzle is different from the assumed position, compared to a case where the inks are simultaneously ejected from all the nozzles.

In addition, in a case where the dot recording of each area is completed in four passes, a case where the dot recording at the pixel positions of the odd number rows is performed in the first and second passes, and the dot recording at the pixel positions of the even number rows is performed in the third and fourth passes is described as an example, but it may be set in such a manner that the dot recording of the even number rows is performed in the first and second passes, and the dot recording at the pixel positions of the odd number rows is performed in the third and fourth passes. In addition, it may be set in such a manner that the dot recording at the pixel position of one of the even number row or the odd number row is performed in the first and third passes, and the dot recording at the pixel position of the other row is performed in the second and fourth passes.

In addition, the arrangement of the responsible pixels in the two masks MS1e and MS1*e in the upper portion of FIG. 11 is the same as that in which the masks MS1 and MS1* illustrated in FIG. 5 are applied to only the pixel position of the even number rows. For example, each pixel row of the masks MS1 and MS1* of FIG. 5 is used as the even numbered pixel rows with the odd-numbered pixel rows inserted therebetween. In the same manner, the two masks MS1o and MS1*o in the lower portion of FIG. 11 are the same as those in which the masks MS1 and MS1* illustrated in FIG. 5 are applied to only the pixel positions of the odd number rows. Thus, instead of the mask MSD of FIG. 11, the mask MS of FIG. 5 is stored in the non-volatile memory device, and the applied pixel row of the mask MS is switched, and thereby it is possible to perform the rasterizing control. In this way, it is possible to reduce a memory capacity for the mask. Such a modification can also be applied to the other embodiments described in the following description.

In other words, the mask MS can be used to perform the dot recording illustrated in FIGS. 12A-12D. The mask MS (or portions thereof) can simply be applied to different portions and used repeatedly. In effect, the mask MSD of FIG. 11 can be generated from the mask MS as described above.

Figure 13:
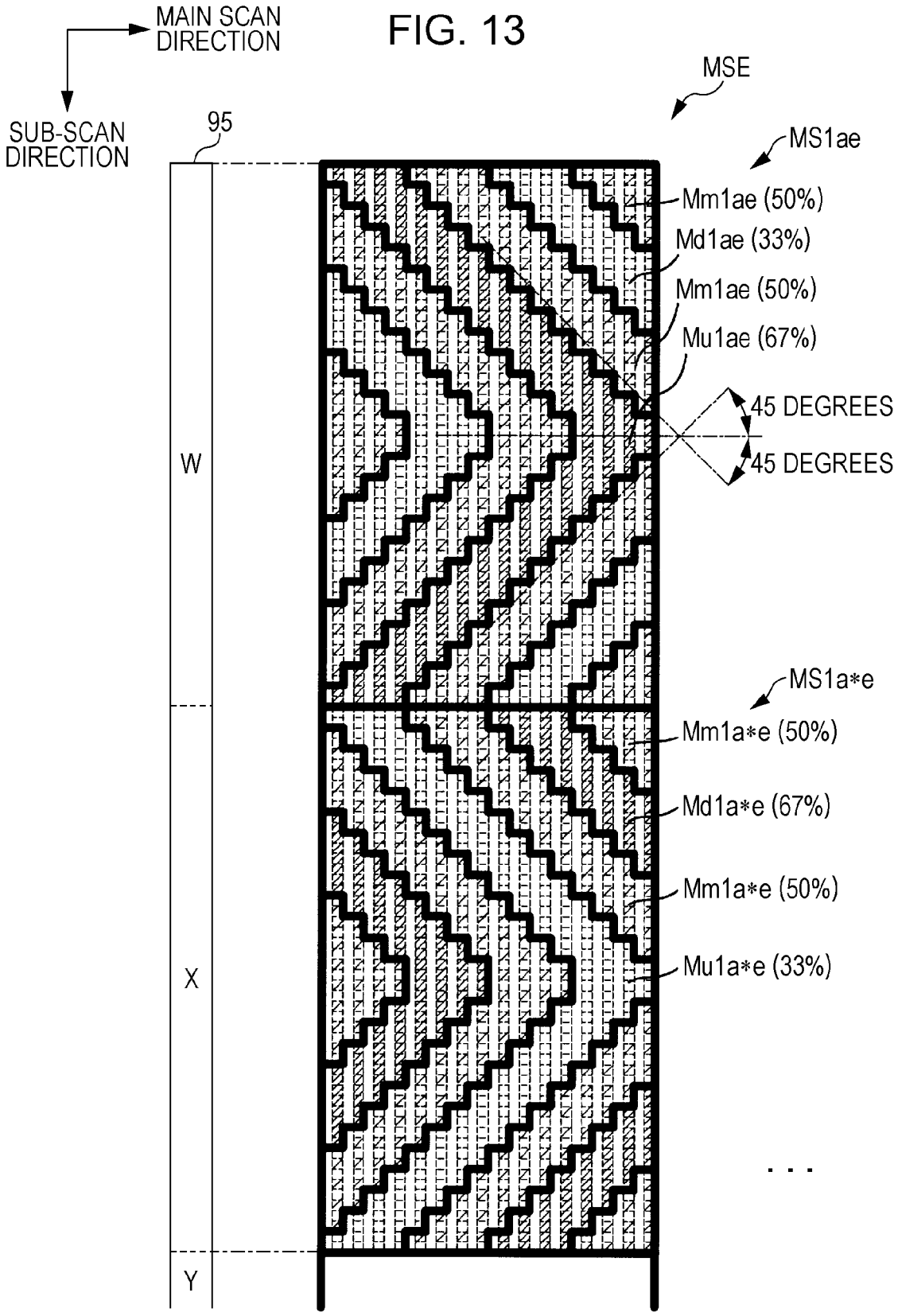
FIG. 13 is an explanatory diagram illustrating an example of the mask for forming a dot recording pattern in each pass.
Figure 14:
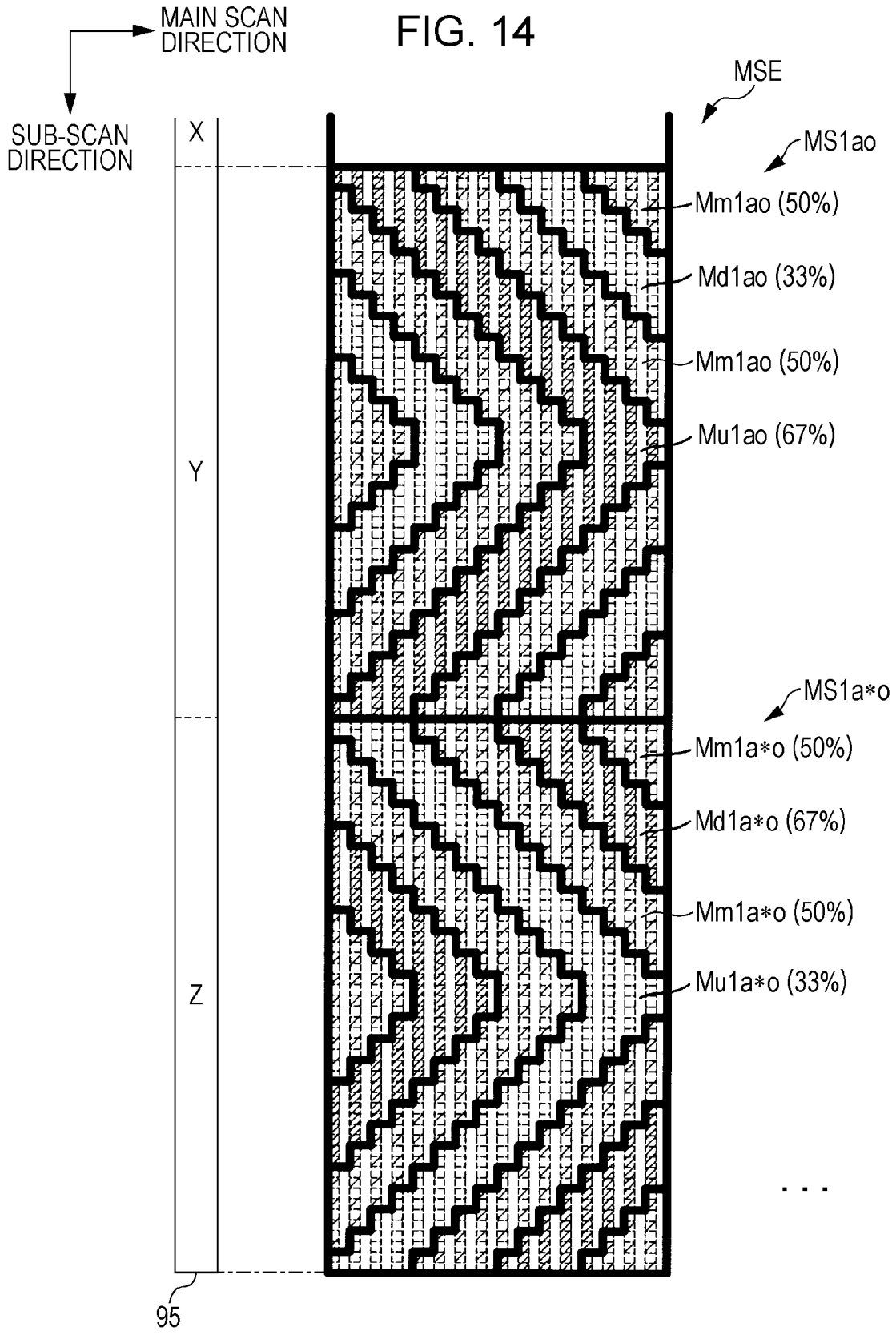
FIG. 14 is another explanatory diagram illustrating a mask for forming a dot recording pattern in each pass.

FIGS. 13 and 14 are explanatory diagrams illustrating a mask for forming a dot recording pattern in each pass. In FIGS. 13 and 14, N, which is the number of passes of the multi-pass recording, is 4 (N may be other numbers). In the mask MSD illustrated in FIG. 11 described above, the mask areas in which dot rates different from each other are assigned are divided by boundaries in parallel with each other in the sub-scan direction. In contrast, in the mask MSC, the mask areas in which dot rates different from each other are assigned are formed so as to have zigzag shapes.

The mask MSE illustrated in FIG. 13 is configured by or includes a first mask MS1ae and a second mask MS1a*e (FIG. 13) for dot recording in the pixel position of the even number row, and a third mask MS1ao and a fourth mask MS1a*o (FIG. 14) for dot recording in the pixel position of the odd number row. The first mask MS1ae and the second mask MS1a*e relate to the even-numbered pixels in the main scan direction, and the pixel positions of the dot recording have a complementary relationship with each other. The third mask MS1ao and the fourth mask MS1a*o relate to the odd-numbered pixels in the main scan direction, and the pixel positions of the dot recording have a complementary relationship with each other.

In the same manner as the first mask MS1e (FIG. 11), the first mask MS1ae is sequentially divided into four mask areas Mu1ae (dot rate of even number row is 67%), Mm1ae (dot rate of even number row is 50%), Md1ae (dot rate of even number row is 33%), and Mm1ae (dot rate of even number row is 50%). However, in the four mask areas Mu1ae, Mm1ae, Md1ae, and Mm1ae according to the fourth embodiment, a left and right boundary of each mask area has a linear shape with a tilt of 45 degrees with respect to the main scan direction and the sub-scan direction, and has a shape of mirror symmetry with respect to a center in the sub-scan direction. The second mask MS1a*e has four mask areas Mu1a*e, Mm1a*e, Md1a*e, and Mm1a*e which have a complementary relationship with the four mask areas Mu1ae, Mm1ae, Md1ae, and Mm1ae of the first mask MS1ae, and a left and right boundary of each mask area has a linear shape with a tilt of 45 degrees with respect to the main scan direction and the sub-scan direction, and has a shape of mirror symmetry with respect to a center in the sub-scan direction.

In the same manner as the third mask MS1o (FIG. 11), the third mask MS1ao of FIG. 14 is sequentially divided into four sections of the four mask areas Mu1ao (dot rate of even number row is 67%), Mm1ao (dot rate of even number row is 50%), Md1ao (dot rate of even number row is 33%), and Mm1ao (dot rate of even number row is 50%). In addition, a left and right boundary of each of the four mask areas Mu1ao, Mm1ao, Md1ao, and Mm1ao has a linear shape with a tilt of 45 degrees with respect to the main scan direction and the sub-scan direction, and has a shape of mirror symmetry with respect to the center in the sub-scan direction. In the same manner as the second mask MS1a*e, the fourth mask MS1a*o also has the four mask areas Mu1a*o, Mm1a*o, Md1a*o, and Mm1a*o which have complementary relationships with the third mask MS1ae. A left and right boundary of each mask area has a linear shape with a tilt of 45 degrees with respect to the main scan direction and the sub-scan direction, and has a shape of mirror symmetry with respect to the center in the sub-scan direction.

Also, the dot recording of each area is completed by the dot recording of the odd number row in the main scan direction in the first and second passes, and by the dot recording of the even number row in the main scan direction in the third and fourth passes, among the four passes. At this time, the mask MSE which is used in the dot recording of each pass, in the same manner as the mask MSD (FIG. 11), is set in such a manner that the dot rate is changed repeatedly, gradually and periodically for each section of a constant length of a plurality of pixels lined up in the main scan direction. Thus, it is possible to suppress banding along the main scan direction from occurring. In addition, the dot recording of the odd number row and the dot recording of the even number row are divided, and thereby, an effect that the main scan direction is gradually and periodically divided for a constant section is increased, and it is possible to further suppress the banding along the main scan direction from occurring. In addition, in the mask of FIGS. 13 and 14, since a left and right boundary of each mask area is a linear shape with a tilt of 45 degrees so as not to be a linear shape in parallel with the main scan direction and the sub-scan direction, it is possible to suppress the banding along the sub-scan direction from occurring. In addition, since the mask is set in such a manner that all the nozzles do not eject the inks simultaneously, it is possible to suppress a concern that a landing position of the ink ejected by an airflow occurring according to the ink ejected from the nozzle is different from the assumed position, compared to a case where the inks are simultaneously ejected from all the nozzles.

Embodiments of the present invention, including those discussed herein, are intended to facilitate an understanding of the invention, and are not intended to limit the invention. Embodiments of the invention are not limited to the embodiments or the reference forms, the examples, and the modifications examples which are described above, and can be realized by various configurations in a range without departing from the gist. For example, the technical characteristics of the embodiments, the examples, and the modification examples which correspond to the technical characteristics of each form described in a column of the summary of the invention can be appropriately replaced or combined, in order to achieve a portion or all of the above-described advantage, or in order to achieve a portion or all of the above-described effects. In addition, it is possible to appropriately remove the technical characteristics, if it is not described as being essential in the present specification.

In the above-described embodiments, the number of passes of the multi-pass recording is 2 or 4. However, N may be an arbitrary integer equal to or greater than 2. In addition, as long as a total of the dot rate on each main scan line formed by the N main scan passes is 100%, the dot rate formed in each main scan pass can be set to an arbitrary value. In addition, it is useful to ensure that the positions of the responsible pixels in the N main scan passes do not overlap with each other. In addition, in general, an amount of transmission of the sub-scan performed after one main scan pass is ended be set to a predetermined value corresponding to 1/N of the head height.

In the above-described FIGS. 9 and 13-14, the left and right boundary (boundary extending in the sub-scan direction) of the mask area has a zigzag shape which is configured by a linear line. However, a non-linear shape (including a curve or a polygonal line) of other type may be employed.

In the above-described embodiments, the dot rate is changed in each section of a predetermined length along the main scan direction, but the length of each section may be changed in each section. In addition, the length of each section along the main scan direction may have a range of four pixels (or less) to 10 pixels (or more). In addition, in each section, the responsible pixels on which the dot recording is performed may not be continuous for four or more pixels in the main scan direction (the number of consecutive responsible pixels is equal to or less than three). In the same manner, in each section, the non-responsible pixels on which the dot recording is not performed may not be continuous for four or more pixels in the main scan direction (the number of consecutive non-responsible pixels is equal to or less than three). In this way, the responsible pixels and the non-responsible pixels are dispersed, and banding can be suppressed or prevented from standing out.

In the above-described embodiments, as the dot rate of a plurality of sections, three types of values (e.g., 33%, 50%, and 67%) are used, but any values other than these can be used. However, the number of types of section with a different dot rate may be equal to or greater than two, but the number may be equal to or greater than three. In this way, dot forming states are respectively changed in three or more sections which have different dot rates and thereby banding can be suppressed or prevented from standing out.

In addition, with regard to a plurality of sections which are assigned on each main scan line in one main scan pass, it is preferable that an average value of the dot rate in the plurality of sections be (1/N×100)% (N is the number of passes of multi-pass recording). For example, in a case of N=2, the average value of the dot rate in the plurality of sections lined up in the main scan direction is 50% (FIGS. 4 and 9). In addition, in a case of N=4, the average value of the dot rate in the plurality of sections lined up in the main scan direction is 25% (FIG. 11, FIG. 13, and FIG. 14). In addition, since the values (67%, 50%, 33%, and 50%) of the dot rate which are described in FIG. 11, FIG. 13, and FIG. 14 are values with regard to the pixel positions of the odd number row or the pixel position of the even number row, the values are two times the value of the dot rate with regard to all pixel positions. Thus, it is understood that in FIG. 11, FIG. 13, and FIG. 14, the average value of the dot rate in the plurality of sections lined up in the main scan direction may be 25%.

It addition, as another value of the dot rate, a plurality of pairs in which two values which are complementary with respect to (1/N×100)% are set as one pair be used in one example. For example, in the one embodiment (FIG. 4), 67% and 33% are used as first pair, and 50% and 50% are used as a second pair. If the values of such dot rates are used, there is an advantage that it is easy to set the average value of the dot rate in the plurality of sections lined up in the main scan direction to (1/N×100)%.

In addition, in the above-described embodiments, it has been described that the recording head moves in the main scan direction, but if the ink is ejected by relatively moving the recording medium and the recording head in the main scan direction, the invention is not limited to the above-described configuration. For example, the recording medium may be moved in the main scan direction in a state where the recording head is stopped. In addition, both the recording medium and the recording head may be moved in the main scan direction. In addition, also with regard to the sub-scan direction, the recording medium and the recording head may be moved relatively. For example, like a flatbed type printer, the recording may be performed by moving a head portion in XY directions with regard to the recording medium mounted (fixed) on a table. That is, the recording medium and the recording head may be configured so as to be able to relatively move in at least one of the main scan direction and the sub-scan direction.

In the above description, the printing apparatus which ejects the ink on the printing paper is described, but embodiments of the invention can also be applied to various dot recording apparatuses in addition to the printing apparatus, and can also be applied to an apparatus which forms dots by ejecting droplets on a substrate, for example. Furthermore, embodiments of the invention may employ a liquid ejection apparatus which ejects or discharges liquids other than the ink, and can be used for various liquid ejecting apparatuses which include liquid ejecting heads or the like which ejects droplets of a small amount. In addition, droplets means a state of liquid which is ejected from the above-described liquid ejecting apparatus, and includes drawing a trail in a grain shape, a tear shape, and a thread shape. In addition, the liquids described above may be materials which can be ejected by the liquid ejecting apparatus. For example, the liquid may be a state where a material is in a liquid phase, and includes a liquid state with high or low viscosity, a sol, gel water, another inorganic solvent, an organic solvent, a solution, a liquid resin, a flow state such as a liquid state metal (molten metal liquid), not only a liquid with material in one state but also that in which particles of functional materials consisting of solid materials such as pigments or metal particles are dissolved, dispersed or mixed in a solvent, or the like. In addition, as a representative example of the liquids, ink or liquid crystal as described in the above-described embodiments are included. Here, the ink includes various liquid compositions such as a general water-based ink, oil-based ink and gel ink, and hot-melt ink. As a specific example of the liquid ejecting apparatus, for example, a liquid crystal display, an EL (Electroluminescence) display, a surface light emitting display, or a liquid ejecting apparatus that ejects liquid which contains materials such as electrode materials or color materials used in manufacturing a color filter or the like in a dispersed or melted form, may be used. In addition, the liquid ejecting apparatus may be a liquid ejecting apparatus which ejects living organic material used in manufacturing a bio chip, a liquid ejecting apparatus used as a precision pipette which ejects liquid consisting of a sample, a textile printing apparatus, a micro-dispenser, or the like. Furthermore, a liquid ejecting apparatus which ejects lubricating oil into a precision machine such as a watch or a camera using a pinpoint, a liquid ejecting apparatus which ejects transparent resin liquid such as ultraviolet curable resin onto a substrate in order to form a minute hemispherical lens (optical lens) or the like used in an optical communication element, or a liquid ejecting apparatus which ejects etching liquid such as an acid or an alkali in order to etch a substrate or the like, may be employed.

What is claimed is:

1. A dot recording apparatus comprising:

a recording head that includes a plurality of nozzles in a nozzle row;

a main scan driving mechanism that moves the recording head relative to a recording medium in a main scan direction and performs a main scan pass that forms dots on the recording medium; and a control unit, wherein the control unit performs multi-pass recording which completes forming of the dots on a main scan line by N (N is an integer equal to or greater than 2) main scan passes, wherein a dot rate which represents a rate of pixels in which dot recording is performed in each main scan pass of the multi-pass recording, is set so as to be changed gradually and periodically over a plurality of sections in the main scan direction, wherein each section is separated by a boundary with a non-linear shape repeated in a predetermined period along a direction intersecting the main scan direction.

2. The dot recording apparatus according to claim 1, wherein the non-linear shape is set in such a manner that a shape of a first half period and a shape of a second half period of the period have minor symmetry.

3. The dot recording apparatus according to claim 1, wherein the non-linear shape is a zigzag shape with a tilt of 45 degrees with respect to the main scan direction and the direction intersecting the main scan direction.

4. The dot recording apparatus according to claim 1, wherein a number of values of the dot rates different from each other in the plurality of sections lined up in the main scan direction is set so as to be equal to or greater than 3.

5. The dot recording apparatus according to claim 1 further comprising a sub-scan driving mechanism which performs a sub-scan that moves the recording medium relative to the recording head in a sub-scan direction that intersects with the main scan direction.

6. A dot recording method for a dot recording apparatus that performs a main scan pass which moves a recording head relative to a recording medium in a main scan direction and forms dots on the recording medium, and thereby performs multi-pass recording which completes forming of the dots on a main scan line by N (N is an integer equal to or greater than 2) the main scan passes, the method comprising:

setting a dot rate which represents a rate of pixels in which dot recording is performed in each main scan pass of the multi-pass recording, wherein the dot rate is changed gradually and periodically over a plurality of sections in the main scan direction, wherein each section is separated by a boundary with a non-linear shape repeated in a predetermined period along a direction intersecting the main scan direction.

7. A non-transitory computer readable media that stores a program that when executed by a processor causes a computer to produce raster data for performing dot recording in a dot recording apparatus which performs a main scan pass that moves a recording head relative to a recording medium in a main scan direction and forms dots on the recording medium, the program causing the computer to realize the functions of:

producing raster data for performing multi-pass recording which completes forming of the dots on a main scan line by N (N is an integer equal to or greater than 2) main scan passes in a dot recording apparatus;

setting a dot rate which represents a rate of pixels in which dot recording is performed in each main scan pass of the multi-pass recording, wherein the dot rate is changed gradually and periodically over a plurality of sections in the main scan direction, wherein each section is separated by a boundary with a non-linear shape repeated in a predetermined period along a direction intersecting the main scan direction.

* * * * *